United States Patent [19]

Fukase et al.

[11] Patent Number: 4,986,336

[45] Date of Patent: Jan. 22, 1991

[54] TWIN-ROLL TYPE CONTINUOUS CASTING MACHINE

[75] Inventors: Hisahiko Fukase, Tokyo; Kunio Matsui; Akihiro Nomura, both of Yokohama; Atsushi Hirata, Hiratsuka, all of Japan

[73] Assignee: Ishikawajima-Harima Heavy Industries Co., Ltd., Tokyo, Japan

[21] Appl. No.: 384,597

[22] Filed: Jul. 25, 1989

[30] Foreign Application Priority Data

Jul. 26, 1988 [JP] Japan ..... 63-184750
Sep. 9, 1988 [JP] Japan ..... 63-224507

[51] Int. Cl.[5] ..... B22D 11/06
[52] U.S. Cl. ..... 164/415; 164/428
[58] Field of Search ..... 164/480, 428, 415, 475

[56] References Cited

FOREIGN PATENT DOCUMENTS 57-25261 2/1982 Japan ..... 164/475
58-359 1/1983 Japan ..... 164/480
59-199152 11/1984 Japan ..... 164/480
61-219449 9/1986 Japan ..... 164/480
61-289951 12/1986 Japan ..... 164/415
1218365 1/1971 United Kingdom ..... 164/475

*Primary Examiner*—Kuang Y. Lin
*Attorney, Agent, or Firm*—Dykema Gossett

[57] ABSTRACT

A twin-roll type continuous casting machine for fabricating a metal sheet from molten metal supplied from a ladle comprises a pair of spaced rolls, side weirs disposed on each roll in the lateral direction of the roll, a tundish for reserving the molten metal and supplying the molten metal through a feeder, which is provided above the rolls and below the tundish, to form a melt pool on the upper side of the gap between the rolls so as to fabricate the metal sheet through the gap between the rolls, a pressurizing chamber formed between the rolls and the tundish for gas-pressurizing the melt surface of the melt pool. The arrangement allows the ladle to easily supply the molten metal to the tundish and ensures easy maintenance of the tundish.

12 Claims, 3 Drawing Sheets

(PRIOR ART)

TWIN-ROLL TYPE CONTINUOUS CASTING MACHINE

BACKGROUND OF THE INVENTION

1. Technical Field

The present invention relates to a twin-roll type continuous casting machine for producing a metal sheet through the gap between a pair of rolls with a pool of a molten metal being formed on the upper side of the gap between the rolls, and more particularly to a twin-roll type continuous casting machine having an improved construction for pressurizing the melt surface of the melt pool with a gas.

2. Background Art

In recent years research and development has resulted in a twin-roll type continuous casting machine in which a molten metal (hereinafter referred to as "melt") is supplied to the upper side of the gap between a pair of rotating rolls to form a melt pool, and a gas pressure is applied to the melt surface of the melt pool to continuously produce a metal sheet directly through the gap between the rolls.

In connection with such twin-roll type continuous casting machines, it is known that when the melt is brought into contact with the pair of cooled rolls in a pressurized state, it is possible to solidify the melt in a condition of a high rate of heat transfer, thereby enhancing the qualities and flatness of the metal sheet thus cast, and to increase the thickness of the sheet.

In view of the above, there has been proposed, as disclosed in Japanese Pat. Application No. 59-137162 (1984), a continuous casting machine which comprises, as shown in FIG. 4 of the present drawings, a pressurizing chamber 11 formed so as to entirely surround a tundish 5 on the upper side of the rolls 1.

In the above-mentioned continuous casting machine, however, the construction, in which the pressurizing chamber 11 surrounds the tundish 5 entirely for momentarily reserving the melt to be supplied to the gap between the rolls 1, makes it impossible to appropriately supply the melt into the tundish 5 by a ladle (not shown). It is therefore necessary to provide a melting furnace 50 in the pressurizing chamber 11 in order to supply an adequate melt 3 into the tundish 5, and hence the pressurizing chamber 11 is necessarily large. In addition, the presence of the tundish 5 in the pressurizing chamber 11 renders the maintenance of the tundish 5 difficult. Meantime, in FIG. 4, numeral 51 denotes a melt outlet port of the melting furnace 50, and numeral 52 denotes a valve for opening/closing the melt outlet port 51.

SUMMARY OF THE INVENTION

It is accordingly an object of the present invention to provide a twin-roll type continuous casting machine which permits a smaller pressurizing chamber, an appropriate supply of the melt into the tundish by the ladle, and easy maintenance of the tundish.

To achieve the above object, the present invention provides a twin-roll type continuous casting machine which comprises a pair of rolls provided with side weirs along the lateral portions thereof, and a tundish for supplying a molten metal through a feeder to form a melt pool on the upper side of the gap between the rolls, so as to produce a metal sheet through the gap between the rolls, characterized in that a pressurizing chamber for gas-pressurizing the melt surface of the melt pool is formed between the rolls and the tundish.

With the pressurizing chamber provided between the rolls and the tundish, it is possible to appropriately pressurize the melt surface of the melt pool and to appropriately supply the melt into the tundish by the ladle.

Consequently, a constant amount of the melt is secured in the melt pool and a metal sheet of good qualities is continuously produced through the gap between the rolls. Moreover, the location of the tundish in the exterior of the pressurizing chamber permits easy maintenance of the tundish.

Where a gas pressure source for supplying a constant gas pressure is connected to the pressurizing chamber and the melt surface level in the tundish is detected by detecting means to cut off by a control means the supply of the gas pressure from the gas pressure source into the pressurizing chamber when the detected level of the melt surface is lowered below a predetermined level, it is possible to obviate the problem of the melt flowing back and being blown up out of the tundish due to the comparatively high gas pressure in the pressurizing chamber.

DESCRIPTION OF THE PREFERRED EMBODIMENT

One embodiment of this invention will now be described while referring to the accompanying drawings.

Figure 1:
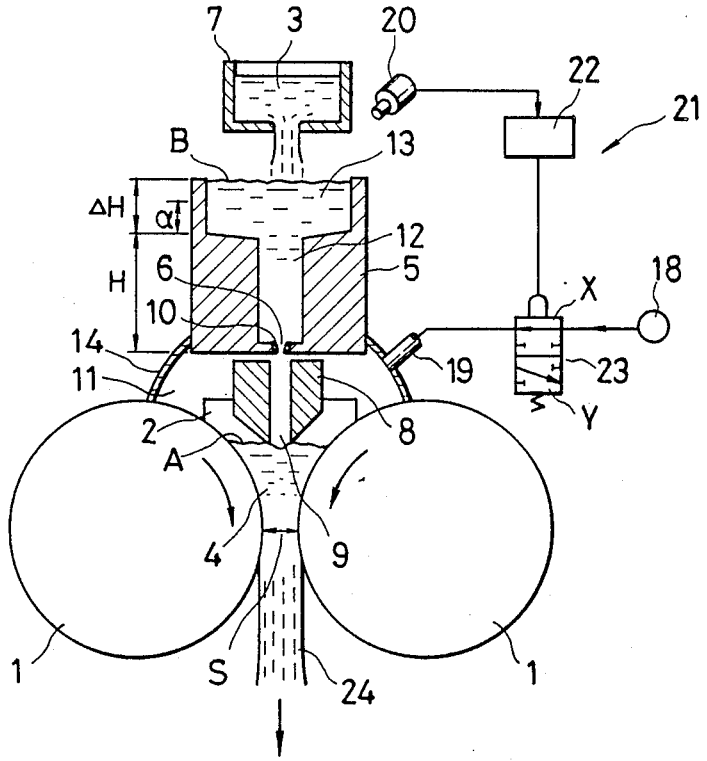
FIG. 1 is a sectional view of a twin-roll type continuous casting machine according to one embodiment of the present invention.

A twin-roll type continuous casting machine is shown in FIG. 1, in which numeral 1 denotes a pair of rolls disposed horizontally and parallel to each other. For the gap S between the rolls 1 to be variable, one or both of the rolls are supported so as to be selectively movable in the radial direction of the roll. The rolls 1 rotate in the directions indicated by the arrows. The interior of each roll 1 constitutes a cooling jacket.

Side weirs 2 are disposed in contact with the rolls 1 in the axial direction of the roll. A melt pool 4 for reserving a molten metal (melt) 3 is formed on the upper side of the gap S between the rolls 1. Above the gap S between the rolls 1, a tundish 5 is provided for supplying a constantly regulated flow of the melt 3 so as to form a proper melt pool 4. The top portion of the tundish 5 is open, whereas the bottom portion of the tundish 5 is bored to form a discharge port 6 for natural discharge of the melt.

Tundish 5 is supplied with the melt 3 by a ladle 7. On the lower side of the tundish 5 is disposed a feeder 8 for guiding the melt discharged from the tundish 5 into the melt pool 4. The feeder 8 is provided with a plurality of passages 9 for the melt 3. A lower end portion of the feeder 8 is immersed in the metal pool 4 to prevent splashing of the melt 3 and to reduce the surface area A of the melt pool (melt surface), thereby suppressing the solidification of the melt 3 at the surface.

Figure 2:
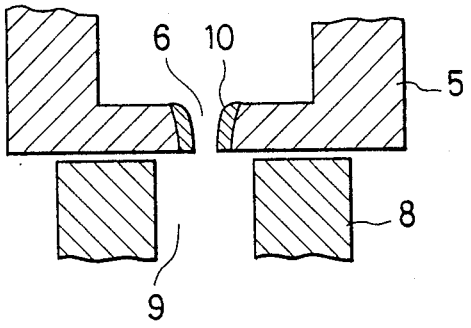
FIG. 2 is a partially enlarged sectional view showing the fitted condition of a flow rate control valve in a tundish shown in FIG. 1.

Each of the discharge ports 6 of the tundish 5 is provided with a detachable nozzle 10 as shown in FIG. 2. The configuration of the nozzle 10 is determined in accordance with a designed flow rate of the melt. Over each nozzle 10 is formed a lower melt reservoir portion 12 having a small cross-sectional area and the depth equal to a head H corresponding to the pressure in a pressurizing chamber 11 (to be described later). Over the lower melt reservoir portion 12 there is formed an upper melt reservoir portion 13 which is greater in cross-sectional area than the lower reservoir portion 12. The head ΔH of the melt 3 in the upper melt reservoir portion 13 discharges the melt 3 through the nozzle 10. The head ΔH is set so as to permit the melt to flow out through the nozzles 10 at a substantially constant flow rate, taking into account the pressure loss across the nozzle 10.

Figure 3:
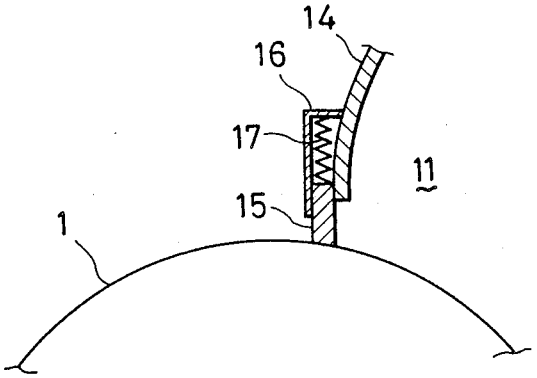
FIG. 3 is a partially enlarged sectional view showing the fitted condition of a seal member of a cover forming a pressurizing chamber shown in FIG. 1.
Figure 4:
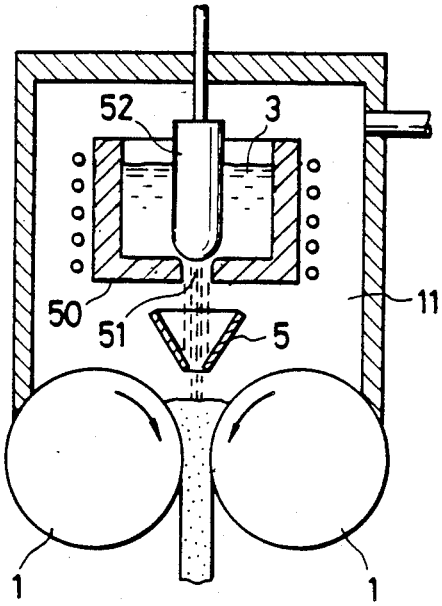
FIG. 4 is a sectional view of a conventional twin-roll type continuous casting machine.

Let the pressure in the pressurizing chamber 11 be ΔP and the flow rate of the melt through the nozzles 10 be Q, then the heads H and ΔH are obtained from the following formulas:

$$H = C_1 \cdot \Delta P / p$$

$$\Delta H = (Q / C_2 \cdot a)^2 / 2g$$

where $\rho$: density of melt $C_1$: proportionality constant $C_2$: flow coefficient of nozzle a: cross-sectional area of nozzle g: acceleration of gravity Between the tundish 5 and the rolls 1, the pressurizing chamber 11 is provided for applying a gas pressure to the melt surface A of the melt pool 4. The pressurizing chamber 11 is formed by a cover 14 arranged to extend from a lower end portion of the tundish 5 to respective upper surfaces of the rolls 1 and upper portions of the side weirs 2. Lower end portions of the cover 14 are connected gas-tight to the side weirs 2. Those portions of the cover 14 that make contact with the upper surfaces of the rolls 1 are fitted with seal members 15 for sealing the pressure of the gas, as shown in FIG. 3. The seal member 15 is vertically movably supported on the lower end portion of the cover 14 through a support frame 16, in which there is fitted a spring 17 for pressing the seal member 15 against the surface of the roller 1. The seal members 15 may be formed of a fluororesin.

A fixed gas pressure located in a position X when the detected value is supplied into the pressurizing chamber 11 from a gas pressure source 18 through a pipe 19. The pressurized gas may be an inert gas such as nitrogen.

Above the tundish 5, a television camera 20 is disposed as a means for detecting the melt surface level B in the tundish 5. The television camera 20 is connected with control means 21 for cutting off the supply of the gas pressure from the gas pressure source 18 into the pressurizing chamber 11 when the melt surface level B is reduced below a predetermined level, for instance, a head of $H+\alpha$. The control means 21 comprises a controller 22 and an electromagnetic selector valve 23 disposed in the pipe 19. The controller 22 receives an output signal from the television camera 20, compares the detected value with a predetermined value, and controls the selector valve 23 in a manner such that the valve is not less than the set value and the valve 23 is changed over from the position X to a position Y when the detected value is lowered below the set value.

The detecting means may be an ultrasonic sensor, or a visual observation may be satisfactory in some cases. Also, the selector valve 23 may be substituted by a pressure control valve.

The operation of this embodiment of the machine will now be explained. When the melt 3 is supplied into the tundish 5 by the ladle 7, the head ΔH causes the melt 3 to be discharged through the nozzles 10 at a substantially constant flow rate, and the melt 3 is supplied through the passages 9 in the feeder 8 just above the gap S between the rolls 1. As a result, the melt pool 4 is formed on the upper side of the gap between the rolls 1, and the melt 3 is extruded by the rotation of the rolls 1 while being solidified due to the contact with the rolls 1, whereby a metal sheet 24 is continuously produced.

During the casting, a fixed gas pressure is supplied from the gas pressure source 18 to the pressurizing chamber 11, and a constant pressure is exerted on the melt surface A of the melt pool 4. Therefore, it is possible to solidify the melt in the condition of a high rate of heat transfer, thereby enhancing the qualities and flatness of the metal sheet 24 cast. Particularly, with the pressurizing chamber 11 provided between the rolls 1 and the tundish 5, it is possible to appropriately and continuously supply the melt 3 into the tundish 5 by the ladle 7. In addition, because the tundish 5 is located outside the pressurizing chamber 11, the maintenance of the tundish 5 is easy.

Furthermore, since the feeder 8 is disposed in the pressurizing chamber 11 formed continuous to the tundish 5, it is unnecessary to seal between the tundish 5 and the feeder 8. This means that a gap between the tundish 5 and the feeder 8 presents no problem.

On the other hand, the melt surface level B in the tundish 5 is detected by the television camera 20, and, when the detected value is not less than the set value, the pressurized gas is supplied from the gas pressure source 18 into the pressurizing chamber 11. When the detected value is below the set point, the controller 22 changes over the selector valve 23 from the position X to the position Y, whereby the supply of the pressurized gas into the pressurizing chamber 11 is cut off, and the chamber 11 is opened to the atmosphere. This makes it possible to prevent the problem of the melt 3 being caused to flow back and blown up out of the tundish 5 due to the gas pressure of the chamber 11, during for example, the beginning stage of the casting operation when the supply of the melt from the ladle 7 into the tundish 5 is begun or at the ending stage of the casting operation when the amount of the melt in the tundish 5 is gradually reduced.

Because the interior of the tundish 5 is formed to comprise the lower melt reservoir portion 12 having a small cross-sectional area and the upper melt reservoir portion 13 greater in cross-sectional area than the lower reservoir portion 12, it is possible in the lower reservoir portion 12 to easily secure the head H with a small amount of melt, and it is possible in the upper reservoir portion 13 to reduce the variations in the melt surface level B with variations in the amount of the melt. Namely, it is possible to reduce the effect of the variations in quantity of the melt supplied from the ladle 7 on the melt surface level B in the tundish 5.

Meanwhile, a plurality of passages 9 are bored in the feeder 8 along the axial direction of the roll 1 at appropriate intervals. Therefore, the feeder 8 may have a complicated shape. Particularly, when each passage 9 is designed small in diameter, the feeder 8 may be difficult to form and may cause clogging or the like during the casting operation. However, since the detachable nozzle 10 is provided at each discharge port 6 of the tundish 5, it is possible to design a larger passage 9, thereby ensuring easy formation of the passages 9 and easy positioning of each passage 9 relative to each nozzle 10.

Even if the pressure of the pressurized gas supplied into the pressurizing chamber 11 is constant, the thickness of the metal sheet 24 produced may vary with variations in the level of the melt surface A of the melt pool 4. To overcome this problem, the level of the surface A of the melt pool 4 is adjusted by controlling the rotating speed of the rolls 1 or by regulating the head $\Delta H$ of the upper melt reservoir portion 13 in the tundish 5, whereby it is possible to render the thickness of the metal sheet 24 constant.

What is claimed is:

1. A twin-roll type continuous casting machine for fabricating a metal sheet from molten metal, comprising:

a pair of rolls spaced from each other by a predetermined gap;

side weirs provided on each roll in the lateral direction of the roll;

a tundish for reserving the molten metal and supplying the molten metal toward the gap between the rolls, so as to form a melt pool on the upper side of the gap between the rolls and to fabricate the metal sheet through the gap between the rolls;

a pressurizing chamber formed between the rolls and the tundish for gas-pressurizing the melt surface of the melt pool;

means for detecting the level of molten metal in the tundish; and, means responsive to the detecting means for maintaining the pressure on the melt pool substantially constant.

2. A twin-roll type continuous casting machine as set forth in claim 1, further including a feeder provided above the rolls and below the tundish for guiding the molten metal from the tundish toward the gap between the rolls.

3. A twin-roll type continuous casting machine as set forth in claim 2, wherein the feeder includes a lower end portion disposed at a level beneath the melt pool.

4. A twin-roll type continuous casting machine as set forth in claim 1, wherein the pressurizing chamber is formed by a cover extending from a lower end portion of the tundish to upper surfaces of the rolls over the side weirs.

5. A twin-roll type continuous casting machine as set forth in claim 2, wherein the pressurizing chamber is formed by a cover extending from a lower end portion of the tundish to upper surfaces of the rolls over the side weirs.

6. A twin-roll type continuous casting machine as set forth in claim 4, wherein the cover is provided with a seal member pressed against the surfaces of the rolls to seal the pressure of the gas.

7. A twin-roll type continuous casting machine as set forth in claim 5, wherein the cover is provided with a seal member pressed against the surfaces of the rolls to seal the pressure of the gas.

8. A twin-roll type continuous casting machine as set forth in claim 1, wherein the control means includes:

a gas pressure source for supplying gas to the pressurizing chamber; and, control means for cutting off the supply of gas from the gas pressure source to the pressurizing chamber when a preselected level of molten metal in the tundish is detected by the detecting means.

9. A twin-roll type continuous casting machine for fabricating a metal steel from molten metal, comprising:

a pair of rolls spaced from each other by a predetermined gap;

side weirs provided on each roll in the lateral direction of the roll;

a tundish for reserving the molten metal and supplying the molten metal toward the gap between the rolls, so as to form a melt pool on the upper side of the gap between the rolls and to fabricate the metal sheet through the gap between the rolls;

a feeder provided above the rolls and below the tundish for guiding the molten metal from the tundish toward the gap between the rolls;

a pressurizing chamber provided between the rolls and the tundish in order to pressurize the melt surface of the melt pool by a gas;

a gas pressure source for supplying a substantially constant pressure into the pressurizing chamber;

means for detecting the melt surface level in the tundish; and control means for cutting off the supply of the gas pressure from the gas pressure source to the pressurizing chamber when the melt surface level detected by the detecting means is lowered below a predetermined level.

10. The twin-roll type continuous casting machine as set forth in claim 9, wherein the tundish is provided at a bottom portion thereof with a detachable nozzle for discharging the molten metal at a predetermined flow rate, a lower melt reservoir portion provided on the upper side of the nozzle, the lower melt reservoir portion having a small cross-sectional area and a head corresponding to the pressure in the pressurizing chamber, and an upper melt reservoir portion provided on the upper side of the lower melt reservoir portion, the upper melt reservoir portion being greater in cross-sectional area than the lower melt reservoir portion.

11. The twin-roll type continuous casting machine as set forth in claim 9, wherein the detecting means comprising a television camera.

12. The twin-roll type continuous casting machine as set forth in claim 9, wherein the control means comprises a selector valve disposed in a pipe connected between the pressurizing chamber and the gas pressure source, and a controller for shutting off the selector valve when the melt surface level detected by the detecting means is lower than a predetermined level.

* * * * *